US008632123B2

(12) United States Patent
Barile

(10) Patent No.: US 8,632,123 B2
(45) Date of Patent: Jan. 21, 2014

(54) GANGING CUP-HOLDER

(75) Inventor: Peter W. Barile, Morristown, TN (US)

(73) Assignee: Daniel Paul Chairs, LLC, Morristown, TN (US)

( * ) Notice: Subject to any disclaimer, the term of this patent is extended or adjusted under 35 U.S.C. 154(b) by 469 days.

(21) Appl. No.: 12/950,218

(22) Filed: Nov. 19, 2010

(65) Prior Publication Data

US 2012/0126588 A1 May 24, 2012

(51) Int. Cl.
*A47C 7/62* (2006.01)

(52) U.S. Cl.
USPC ..... 297/188.2; 297/248

(58) Field of Classification Search
USPC ..... 297/188.14, 188.18, 248, 188.2, 297/188.01, 153
See application file for complete search history.

(56) References Cited

U.S. PATENT DOCUMENTS

| | | | | | |
|---|---|---|---|---|---|
| 506,085 | A | * | 10/1893 | Whelan | 297/160 |
| 2,807,315 | A | * | 9/1957 | Manne | 297/188.06 |
| 4,659,099 | A | * | 4/1987 | Malone | 280/304.1 |
| 4,668,010 | A | * | 5/1987 | Fujiwara | 297/150 |
| 5,533,782 | A | * | 7/1996 | Goldman | 297/188.18 |
| 5,865,412 | A | * | 2/1999 | Mason | 248/311.2 |
| 5,957,530 | A | * | 9/1999 | Gutgsell | 297/248 |
| 7,585,021 | B2 | * | 9/2009 | Tabata | 297/188.14 |

* cited by examiner

*Primary Examiner* — David Dunn
*Assistant Examiner* — Timothy J Brindley
(74) *Attorney, Agent, or Firm* — Pitts & Lake, P.C.

(57) ABSTRACT

A ganging cup-holder 10 is described herein and illustrated by the accompanying figures. The ganging cup-holder 10 is intended for use with two adjacent temporary seating chairs 102 to (1) temporarily secure the two adjacent chairs 102 in a substantially fixed position relative to one another and (2) to provide a convenient location for the placement of items, to prevent damage or loss of items or to prevent spillage of the contents of an item.

10 Claims, 5 Drawing Sheets

GANGING CUP-HOLDER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

The present invention relates to device for connecting two chairs together.

2. Description of the Related Art

Many establishments that utilize temporary seating, such as reception halls, and convention facilities, utilize temporary seating for its ability to be easily stored in a limited space when not in use. Temporary seating is also light weight and portable and can be easily removed from storage, placed in a predetermined configuration, reconfigured, and placed back into storage for later use.

These beneficial properties of temporary seating also present a problem in that chairs that are utilized as temporary seating can be easily shifted out of their predetermined configuration during set up and use. As a consequence, there is a necessity for these chairs to be connected or "ganged" together into rows so that the predetermined configurations can be maintained through the setup and use of the temporary seating.

Also, many examples of temporary seating, such as stackable chairs, by their nature, are minimal in design. As a result, conventional temporary seating requires users to store items in inconvenient locations under or in front of the chair. Items stored under the chair are difficult to reach and prone to being forgotten. Items stored in front of the chair are underfoot and are prone to being damaged, lost or spilled.

BRIEF SUMMARY OF THE INVENTION

A ganging cup-holder includes of a container support region attached to a series of securing members that connect the ganging cup-holder to the horizontal framing members of two adjacent chairs thereby orienting the chairs in a substantially fixed position relative to one another and also providing an area for the convenient placement of hand-held items. The function of the ganging cup-holder is to (1) secure two adjacent chairs in a substantially fixed position relative to one another and (2) provide a convenient location for the placement of items to prevent damage or loss of items or spillage of the contents of a container.

BRIEF DESCRIPTION OF THE SEVERAL VIEWS OF THE DRAWINGS

The drawings that depict the various views and embodiments are as follows.

DETAILED DESCRIPTION OF THE INVENTION

A ganging cup-holder is described herein and illustrated by the accompanying figures. The ganging cup-holder is intended for use with two adjacent temporary seating chairs to (1) temporarily secure the two adjacent chairs in a substantially fixed position relative to one another and (2) to provide a convenient location for the placement of items, to prevent damage or loss of items or to prevent spillage of the contents of an item.

Figure 1:
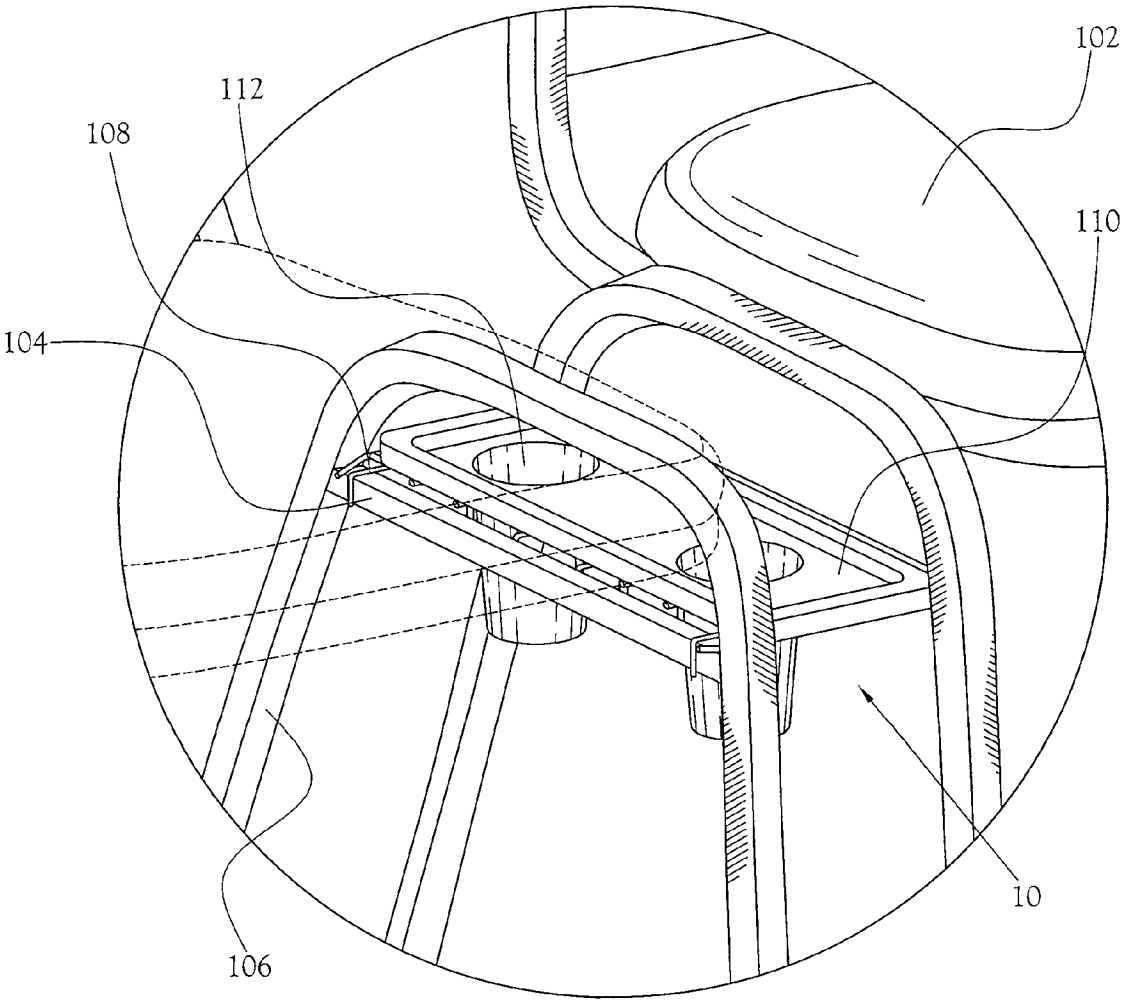
FIG. 1 is an axonometric view of one embodiment of the invention engaging two adjacent chairs.

FIG. 1 is an axonometric view of one embodiment of the ganging cup-holder used with two adjacent chairs 102, each having horizontal framing members 104 extending between vertical framing members 106 (e.g., the chair legs). The ganging cup-holder includes a support frame 108 and a container support region 110. The support frame 108 removably connects to or rests upon at least one of the horizontal framing members 104 of each of the two adjacent chairs 102. When connected as shown, the ganging cup-holder 10 temporarily and substantially fixes the relative position of the two chairs 102. The container support region 110 is supported by the support frame 108 to provide a substantially horizontal and level platform onto which items may be placed. In the illustrated embodiment, the container support region 110 provides multiple receptacles 112 to receive items for temporary storage. The container support region 110 is removable from the support frame 108 for cleaning or storage purposes.

Figure 2:
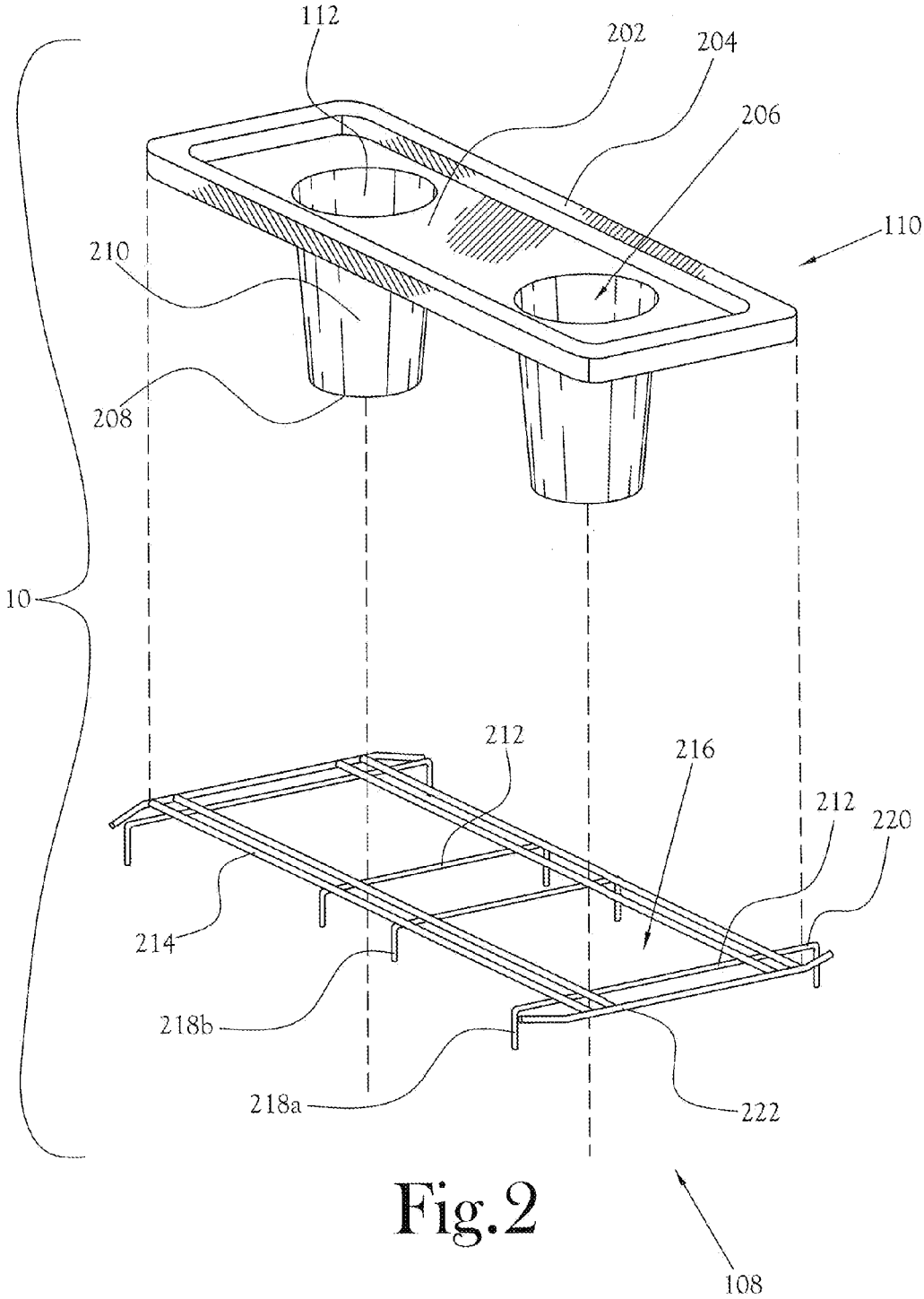
FIG. 2 is an exploded axonometric of the embodiment depicted in FIG. 1.

FIG. 2 illustrates an exploded axonometric view of the embodiment of the ganging cup-holder 10 depicted in FIG. 1. The container support region 110 includes a substantially planar support platform 202. A perimetrical lip 204 bounding the support platform 202 adds structural support to inhibit flexion of the container support region 110 and serves as a retaining wall to contain spills and restrict items from moving laterally beyond the extents (i.e., falling off) of the container support region 110.

The illustrated embodiment of the container support region 110 includes two receptacles 112 for the temporary storage of items. Each receptacle 112 is defined by the walls of an upwardly opening blind frustum. The receptacle opening 206 is defined by the support platform 202 thereby making the receptacle 112 accessible from above (e.g., from a seated position). The closed bottom 208 of the receptacle 112 provides vertical support and the receptacle walls 210 laterally retain and provide lateral support for objects placed within. In the illustrated embodiment, the receptacles 112 are defined by an upwardly opening blind inverted conical frustum (i.e. the larger base is open and positioned above the smaller closed base). Selecting a tapered shape, such as a cone, allows the container support region 110 to be stacked for convenient storage when not in use. The receptacles 112 in the illustrated embodiment are sized and shaped to accommodate standard beverage containers; however, other shapes and dimensions for the receptacles 112 may be used without departing from the scope and spirit of the invention.

The container support region 110 is constructed of a substantially rigid material to resist flexion under its intended use. For certain embodiments, the material is also sufficiently non-porous to resist liquids seeping through the container support region 110. Further, the material is substantially able to withstand damage or deformation from liquids and stresses placed upon the container support region 110 during its intended use. Suitable materials include many plastics, metals, and woods.

The illustrated support frame 108 is formed from a number of cooperative chair retention members 212 oriented substantially perpendicular to a number of connecting members 214. The chair retention members 212 are situated substantially parallel to each other and spaced apart from each other by a selected distance. The connecting members 214 attach to each of the chair retention members 212 to keep the chair retention members 212 in their designated formation and to provide a structurally sound support for the container support region 110. As with the chair retention members 212, the connecting members 214 are spaced apart from each other by a selected distance. The arrangement and spacing of the chair retention members 212 and the connecting members 214 is selected to provide a number of openings 216 that are at least equal to the number of receptacles 112 provided within the container support region 110. Each opening 216 is sized to receive the body of the corresponding receptacle 112 thereby allowing the support platform 202 to rest on the chair retention members 212 and the connecting members 214.

In order to secure the ganging cup-holder 10 in place and to maintain the relative position of the chairs, each chair retention member has two substantially vertical downward extensions 218*a*, 218*b* that capture the horizontal framing members 104 of the two adjacent chairs 102 to inhibit the lateral movement of the chairs 102 relative to each other. In the illustrated embodiment, the end portions 220 of certain chair retention members 212 are designed to rest upon the horizontal framing members 104 thereby supporting the ganging cup-holder 10.

In the illustrated embodiment, the support frame 108 also includes two bumper members 222 connected to the ends of the connecting members 214. The bumper members 222 substantially limit the movement of the support frame 108 between the vertical framing members 106 of each chair 102 thereby also substantially limiting the fore and aft lateral movement of the chairs 102 relative to one another. The per members 222 also serve to occupy the ends of the connecting members 214 to protect against clothing or objects being caught on the ends of the connecting members 214.

The support frame 108 is constructed of a substantially rigid material to resist bending and flexion under the ganging cup holder's intended use. The material is also sufficiently able to withstand damage or deformation from stresses placed upon the support frame 108 during its intended use. Suitable materials include many plastics, metals, or woods. The material selected for constructing the support frame 108 also determines the method of connecting the various members that make up the support frame 108. The connecting method is sufficiently strong to enable the support frame to resist damage under the support frame's intended use.

Figure 3:
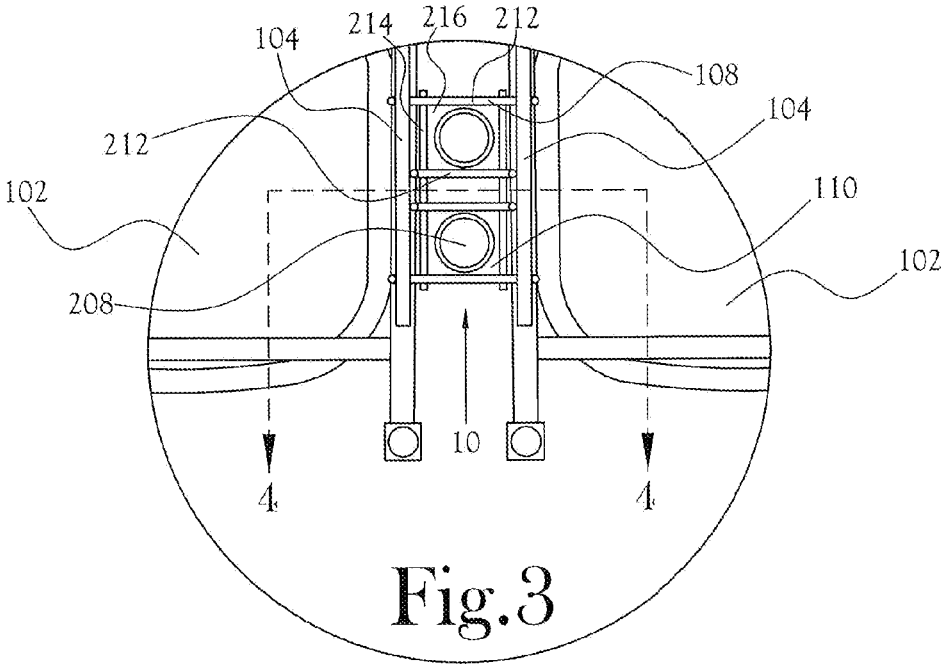
FIG. 3 is a bottom plan view of the embodiment shown in FIG. 1 taken from beneath the ganging cup-holder engaging two adjacent chairs.

FIG. 3 illustrates a bottom plan view of the ganging cup-holder 10 depicted in FIG. 1 engaging two adjacent chairs 102 looking at the underside of the container support region 110. The illustrated embodiment depicts how the receptacles 112 fit within the openings 216 defined by the support frame 108.

Figure 4:
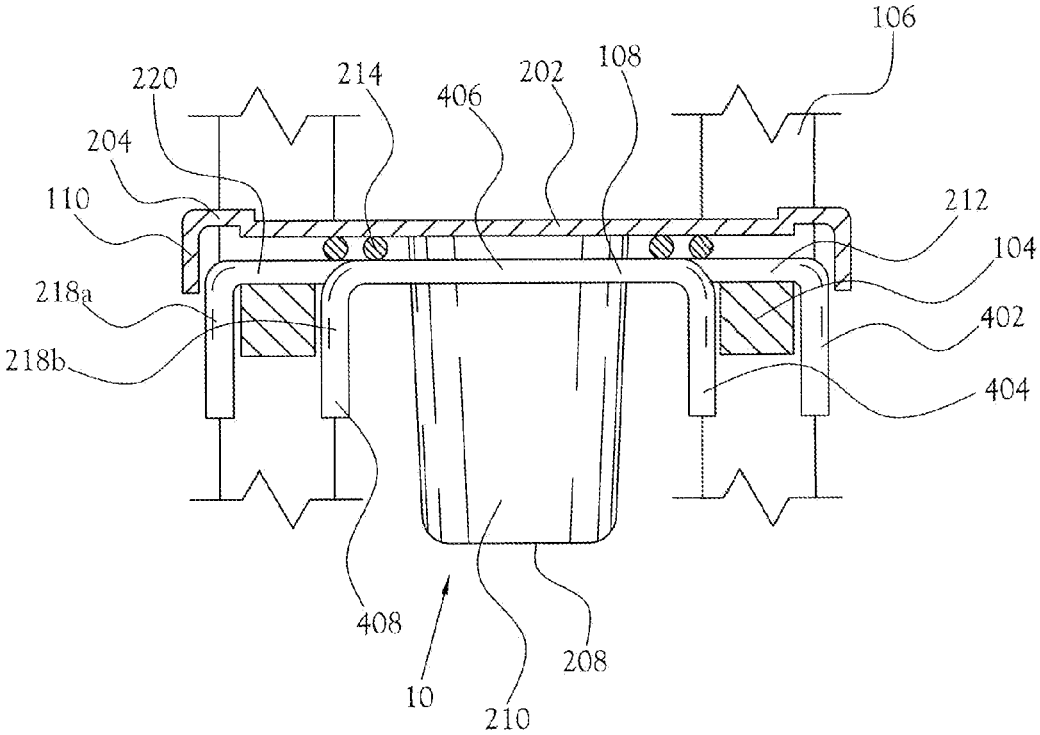
FIG. 4 is a cross-section view, taken as indicated in FIG. 3, of the embodiment shown in FIG. 1 where the ganging cup-holder is engaging two adjacent chairs.

FIG. 4 illustrates a section view of the ganging cup-holder 10 taken as indicated in FIG. 3 showing the ganging cup-holder 10 capturing the horizontal framing members 104 of two adjacent chairs 102. The downward extensions 218*a*, 218*b* extend downward from and are substantially perpendicular to the chair retention members 212 allowing them to capture the horizontal framing members 104 of the adjacent chairs 102. In the illustrated embodiment, the downward extensions 218*a*, 218*b* include outboard capture members 402 that, when capturing a horizontal framing member 104 of two adjacent chairs 102, define the outer limits of the relative movement to the chairs 102. The downward extensions 218*a*, 218*b* also include an inner capture structure 404 that, when capturing a horizontal framing member 104 of two adjacent chairs 102, define the inner limits of the relative movement to the chairs 102. The outboard capture members 402 and the inner capture structure 404 are separated by a selected distance to receive various horizontal framing members 104 within selected ranges of cross sectional thickness.

In the illustrated embodiment, the inner capture structure includes the inboard capture members 408 located at the ends of two short chair retention members 406. The two short chair retention members 406 are substantially co-planar and parallel with the chair retention members 212 and are attached to the connecting members 214 in substantially the same fashion as the chair retention members 212. The location of the short chair retention members 406 are such that they further define the opening 216 that receives the receptacles 112.

In an alternate embodiment, the full size chair retention members 212 carry both the outboard capture members 402 and the inboard capture members 408. The outboard capture members 402 and the inboard capture members 408 are secured to and extend downward from the chair retention members 212 at a selected distance from the ends of the chair retention members 212.

Yet another alternate embodiment of the ganging cup holder 10 the inner capture structure 404 omits the inboard capture members and uses the receptacle wall 210 to define the inner limits of the relative movement of the two adjacent chairs 102.

The end portions 220 of the chair retention members 212, the outboard capture members 402 and the inner capture structure 404 captures the horizontal framing member 104 when the user places the end portions 220 upon the horizontal framing members 104 of adjacent chairs 102. The horizontal distance between the outboard capture member 402 and the inner capture structure 404 is wider than the horizontal framing member 104 such that the horizontal framing member 104 can fit between the outboard capture member 402 and the inner capture structure 404. Depending upon the cross-sectional thickness of the horizontal framing member 104, the chairs 102 may be allowed some limited movement for the user to orient the chairs 102 askew or parallel to one another. Such limited movement, if the dimensions of the horizontal framing members 104 permit, provides the user with the option of arranging the chairs 102 into arcuate or linear seating depending upon the desired configuration. After its use, the ganging cup-holder 10 can be lifted off from the horizontal framing members for cleaning, transportation, or storage.

Figure 5:
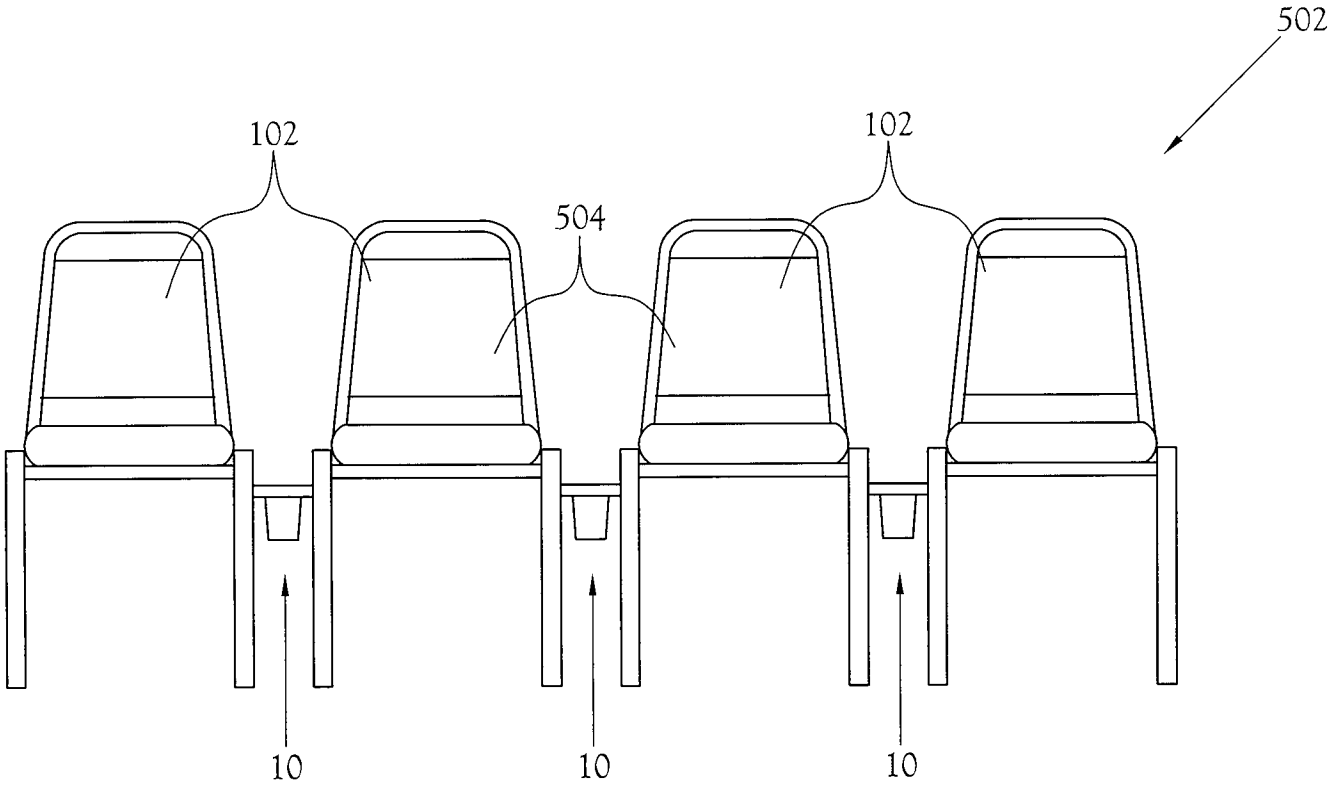
FIG. 5 is an elevation drawing showing a plurality of ganging cup-holders used in conjunction.

FIG. 5 depicts a plurality of ganging cup-holders 10 used in conjunction. Such a configuration creates a row 502 of temporary seating. In such a configuration, each middle chair 504 of the row 502 has two separate ganging cup-holders 10 attached to two separate horizontal framing members 104 on the left and right sides of the chair 102. Each ganging cup-holder 10 is also connected to a horizontal framing member 104 of two adjacent chairs 102. This system is repeated to achieve the desired number of chairs in a row. When used in conjunction, these ganging cup-holders 10 substantially secure multiple chairs 102 in a substantially fixed position during set up and use of the chairs 102.

As an additional matter, certain embodiments of the ganging cup-holder contain a plastic or rubberized cap or coating upon at least those portions of the ganging cup-holder 10 that engage the horizontal framing members 104 and the vertical framing members 106 of the chairs, being the end portions 220, outboard capture members 402, the inner capture structure 404, and the ends of the bumper members 222. Such a cap or coating serves to prevent any damage to the chairs and to also provide an enhanced friction connecting between the ganging cup-holder 10 and the horizontal framing member 104. Additionally, such a cap or coating serves to dampen any sound created by contact between the chairs 102 and the ganging cup-holder 10. This cap or coating also substantially limits the possibility of being scratched by the metal frame 110.

Figure 6:
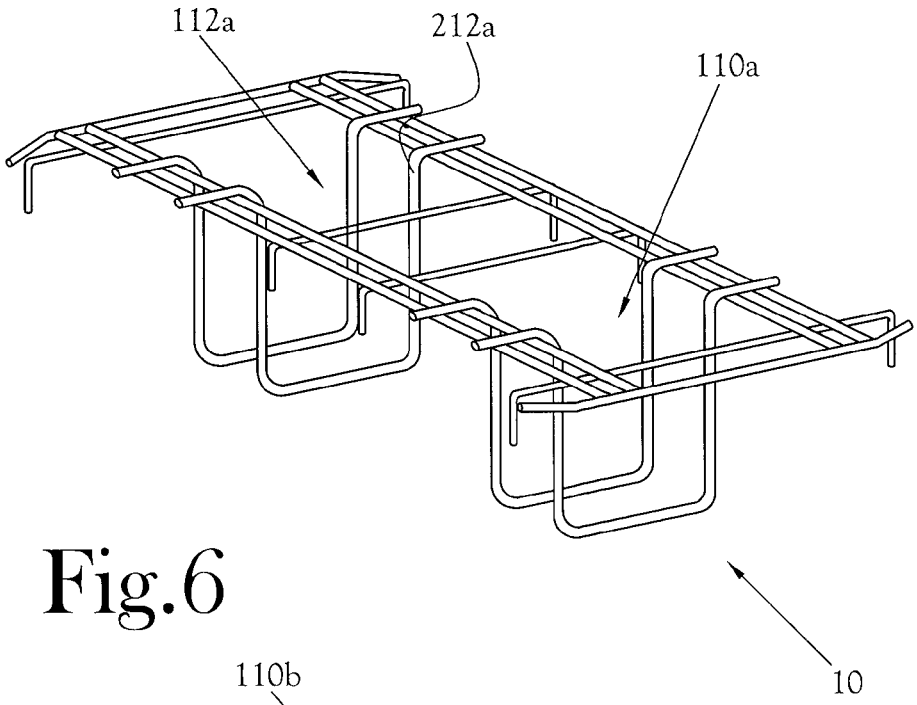
FIG. 6 is a perspective view of an alternate embodiment of the invention.

FIG. 6 illustrates another alternate embodiment of the ganging cup-holder 10 in which the chair retention members 212*a* form both the container support region 110*a* and the receptacles 112*a*. Such an embodiment eliminates the need for a separate piece to act as the container support region 110.

Figure 7:
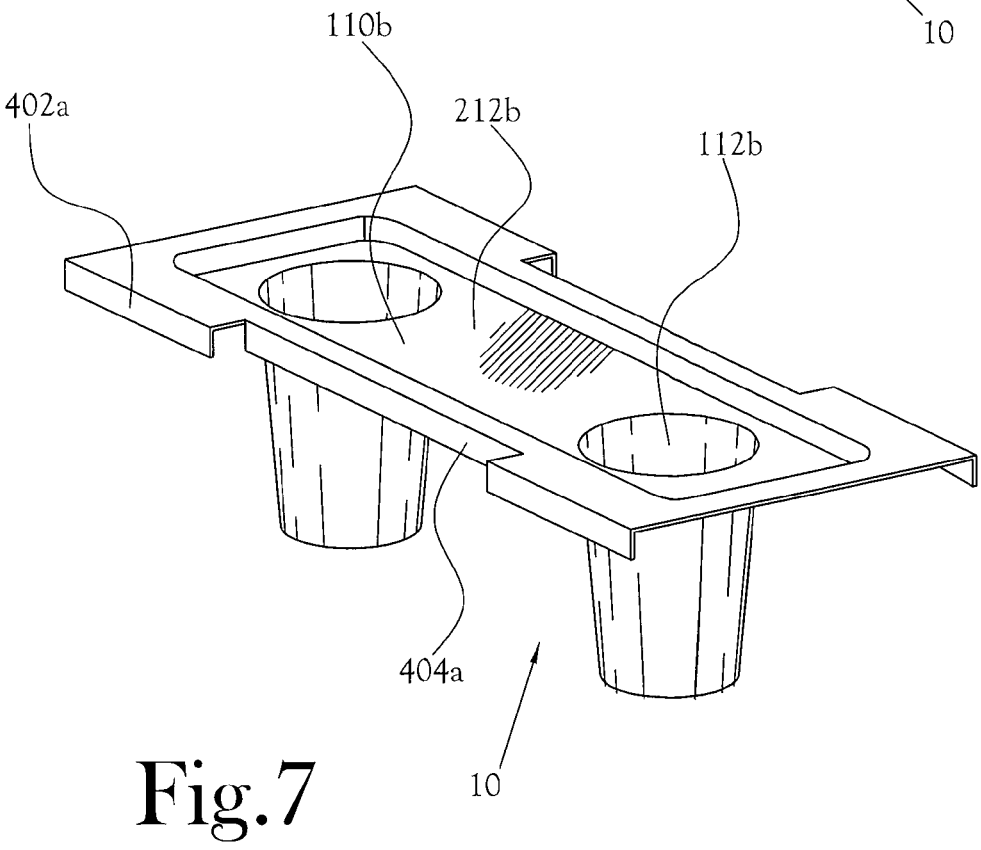
FIG. 7 is a perspective view of another alternate embodiment of the invention.

FIG. 7 illustrates yet another alternate embodiment of the ganging cup-holder 10 that uses a single formed piece of material that integrates a single chair retention member 212*b* and various inboard capture structures 404*a* and outboard capture members 402*a*. The presence of only one chair retention member 212*b* in this embodiment eliminates the need for a separate support frame 108. The single chair retention member 212*b* further integrates and defines the container support region 110*b* and the receptacles 112*b*.

The ganging cup-holder 10 is not intended to be used with any one specific style of chair. The illustrated embodiments are designed to be used with any type of stackable chair that has a horizontal framing member 104 that runs between the vertical framing members 114 on the same side of the chair 102. However, one skilled in the relevant art, after viewing the various embodiments of the ganging cup-holder 10 as illustrated and described herein, would appreciate that embodiments of the ganging cup-holder 10 can be designed to attach to chairs that have alternate support systems such as framing elements that cross beneath the seat of a chair or framing elements that connect the front legs together and the rear legs together.

Further, after reviewing the embodiments illustrated and described herein, one skilled in the art would appreciate that the ganging cup-holder 10 can be constructed in a different manner without deviating from the intent and spirit of the invention. Such alterations include the number and shape of the receptacles 112, the lengths and configuration of the chair retention members 212, the number of outboard capture members 402, or the number or configuration of connecting members 214.

While the present invention has been illustrated by description of several embodiments and described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. A ganging cup holder for fixing the relative position of two adjacent chairs, each of the chairs having a horizontal framing member, the horizontal framing member being substantially horizontal, said ganging cup holder comprising:

a container support region comprising a platform and a receptacle extending downwardly from said platform, said platform being substantially planar and defining a receptacle opening providing access to said receptacle, said receptacle having an exterior wall;

a frame comprising a substantially horizontal portion having:

a first outboard chair retention member proximate to a first end;

a second outboard chair retention member proximate to a second end;

said first outboard chair retention member and said second outboard chair retention member having outboard downward extensions that are substantially perpendicular to and extending downwardly from said substantially horizontal portion, said substantially horizontal portion adapted to extend between and rest upon the horizontal framing members of the two adjacent chairs, said frame capturing the horizontal framing members of the two adjacent chairs between said first outboard capture member and said second outboard capture member; and an inner chair retention member, said inner chair retention member cooperating with each of said first outboard chair retention member and said second outboard chair retention member to capture the horizontal framing member of each of the two adjacent chairs;

wherein said inner chair retention member comprises:

a first inboard capture member connected to said inner chair retention member distal to said first end of said inner chair retention member and extending downward and away from said inner chair retention member;

a second inboard capture member connected to said inner chair retention member distal to said second end of said inner chair retention member and extending downward and away from said inner chair retention member;

said first outboard capture member and said first inboard capture member adapted to capture the first framing member;

said second outboard capture member and said second inboard capture member adapted to capture the second framing member.

2. The ganging cup-holder of claim 1 wherein said frame comprises:

at least one connecting member that fixably attaches to said chair retention members, each at least one connecting member having a first end and a second end, said at least one connecting member securing said chair retention members into a predetermined configuration.

3. The ganging cup-holder of claim 2 wherein said at least one connecting member and said chair retention members cooperatively form said receptacles and said platform.

4. The ganging cup-holder of claim 2 wherein said at least one connecting member is substantially perpendicular to said chair retention members.

5. The ganging cup-holder of claim 2 wherein said container support region is an insert that is supported by said chair retention members.

6. The ganging cup holder of claim 5 wherein said at least one connecting member and said chair retention members are configured to allow said receptacle to pass between said at least one connecting member and said chair retention members.

7. The ganging cup-holder of claim 6 wherein said chair retention members include at least one short chair retention member having a first end and a second end;

said first end of said at least one short chair retention member is connected to said first inboard capture member;

said second end of said at least one short chair retention member is connected to said second inboard chair retention member.

8. The ganging cup-holder of claim 7 further comprising:

a first bumper and a second bumper, each said bumper having a first end and a second end, said first bumper fixably attached to said first end of each said at least one connecting member; said second bumper fixably attached to said second end of each said at least one connecting member;

said first end of said first bumper adapted to engage the front leg of the first chair and said second end of said first bumper adapted to engage the front leg of the second chair, said first end of said second bumper adapted to engage the rear leg of the first chair and said second end of said second bumper adapted to engage the rear leg of the second chair.

9. The ganging cup-holder of claim 8 wherein each said end of said first bumper and each said end of said second bumper contain an angled section, each angled section being substantially angled away from the bumper.

10. A ganging cup holder for fixing the relative position of two adjacent chairs, each of the chairs having a horizontal framing member, the horizontal framing member being substantially horizontal, said ganging cup-holder comprising:

a removable container support region comprising a platform and at least one receptacle extending downwardly from said platform, said platform being substantially planar and defining a receptacle opening providing access to said receptacle;

a plurality of chair retention members wherein each of said plurality of said chair retention members comprises a horizontal portion and a first outboard capture member proximate to a first end and a second outboard capture member proximate to a second end, said first outboard capture member and said second outboard capture member being substantially perpendicular to and extending downwardly from said substantially horizontal portion, said substantially horizontal portion adapted to extend between and rest upon the horizontal framing members of the two adjacent chairs, said frame capturing the horizontal framing members of the two adjacent chairs between said first outboard capture member and said second outboard capture member, said plurality of chair retention members oriented in a substantially parallel configuration;

an inner capture structure cooperating with each of said first outboard capture members and each of said second outboard capture members to capture the horizontal framing member of each of two adjacent chairs, said inner capture structure comprising at least one short chair retention member having a first end and a second end, and being oriented substantially parallel with said plurality of said chair retention members a first inboard capture member connected to said short chair retention member proximate to said first end of said short chair retention member, and extending downward and away from said short chair retention member;

a second inboard capture member connected to said short chair retention member proximate to said second end of said short chair retention member and extending downward and away from said short chair retention member;

at least one connecting member that is substantially perpendicular to and fixably attaches to said plurality of said capture members and said at least one said short chair retention member, said at least one connecting member securing said plurality of said capture members and said at least one said short chair retention member into a predetermined configuration;

said removable container support region resting upon said connecting members, said chair retention members and said short chair retention members such that said receptacles pass between said connecting members, said chair retention members and said short chair retention members;

a first bumper and a second bumper, each said bumper having a first end and a second end, said first bumper fixably attached to said first end of each said at least one connecting member; said second bumper fixably attached to said second end of each said at least one connecting member; said first end of said first bumper adapted to engage the front leg of the first chair and said second end of said first bumper adapted to engage the front leg of the second chair, said first end of said second bumper adapted to engage the rear leg of the first chair and said second end of said second bumper adapted to engage the rear leg of the second chair; each said end of said first bumper and each said end of said second bumper contain an angled section, each angled section being substantially angled away from the bumper.

* * * * *